United States Patent [19]

Collins

[11] Patent Number: 4,545,426

[45] Date of Patent: Oct. 8, 1985

[54] REVERSING TURBULATORS FOR HEAT EXCHANGERS

[75] Inventor: John W. Collins, Beaumont, Tex.

[73] Assignee: Mobil Oil Corporation, New York, N.Y.

[21] Appl. No.: 646,263

[22] Filed: Aug. 31, 1984

[51] Int. Cl.[4] ..... F28G 1/10; B08B 9/04

[52] U.S. Cl. ..... 165/95; 165/94; 15/3.52; 138/38

[58] Field of Search ..... 165/95, 97, 94, 109 T; 15/3.5, 3.52; 138/38

[56] References Cited

U.S. PATENT DOCUMENTS

| | | | |
|---|---|---|---|
| 1,313,624 | 8/1919 | Evans et al. | 138/38 |
| 2,995,451 | 8/1961 | Leach | 165/94 X |
| 3,292,198 | 12/1966 | Perkel | 15/3.52 X |
| 3,394,025 | 7/1968 | McCune | 15/3.5 X |
| 3,473,961 | 10/1969 | Heeren et al. | 165/95 X |
| 4,102,393 | 7/1978 | Withers, Jr. | 165/97 X |
| 4,174,750 | 11/1974 | Nichols | 165/95 X |

FOREIGN PATENT DOCUMENTS

| | | | |
|---|---|---|---|
| 917158 | 8/1954 | Fed. Rep. of Germany | 15/3.52 |
| WO84/01818 | 5/1984 | PCT Int'l Appl. | 165/109 T |
| 603399 | 4/1978 | U.S.S.R. | 165/95 |

*Primary Examiner*—Albert W. Davis, Jr.
*Assistant Examiner*—Peggy A. Neils
*Attorney, Agent, or Firm*—A. J. McKillop; M. G. Gilman; L. G. Wise

[57] ABSTRACT

A turbulator device adapted for insertion into an elongated tube for inducing turbulent fluid flow therein comprising a thin uniform guideline, retention means attached at opposite ends of the guideline for retaining the guideline in the tube; a plurality of slidable spheroidal turbulence inducing elements having a center hole to permit insertion of the guideline therein, a series of spaced apart guideline stop means affixed to the guideline between each of the spheroidal elements, whereby location of turbulent fluid flow zones within the tube may be changed by reversing direction of fluid flow within the tube.

12 Claims, 2 Drawing Figures

REVERSING TURBULATORS FOR HEAT EXCHANGERS

BACKGROUND OF THE INVENTION

This invention relates to improved heat exchange apparatus. In particular, it relates to tube-type heat transfer elements having turbulator devices for improved efficiency and maintenance.

This invention has utility in industrial and/or scientific applications involving heat transfer. A typical use occurs in the operation of refinery equipment, chemical plants and power plants. In such operations, large quantities of operating fluids, often at high temperatures need have heat removed. A presently used mode of heat removal involves the circulating of transfer or working fluid through a large number of tubes. The operating fluids are caused to flow by the working fluid tubes, permitting the exchange of heat between such fluids. Any event that reduces such heat exchange is deleterious to the process. While this example involves exchanging heat from an operating fluid to a cooling working fluid, it is unimportant to this invention the direction of heat exchange, i.e., from operating to working fluid, or vice versa. Of particular concern are [1] the forming of a contaminant layer on the inside tube wall, and [2] the forming of a thin annular, fluid film, sometimes described as a laminar film, of stagnant working fluid, just radially interior of the tube wall. Each of these disruptants apparently tends to reduce the exchange of heat between the adjacent fluids, acting as a heat insulator. Numerous approaches have been used to overcome these problems, such as the chemical and/or mechanical cleaning of the tube. A known system utilizes sponge rubber balls, flowing in a closed circulation system, to clean the tube interior. A brush cleaning system is described in the September, 1975 issue of Heating/Piping/Air Conditioning published by Water Services of America, Inc. The latter system includes cleaning brushes movable in a longitudinally extending tube. The direction of movement of the cleaning fluid may be reversed periodically so as to cause the brushes to traverse the length of the tube. The present system seeks to improve on the tube-cleaning systems described above. There are also different types of turbulators, using all the same basic principle—to mix slow moving fluid at the wall of the tube with the fast moving fluid in the center of the tube. Other heat exchange tube cleaners and/or turbulator devices are disclosed in U.S. Pat. Nos. 4,174,750, 4,412,558 and 4,412,583, incorporated herein by reference.

It is an object of the present invention to provide improved heat exchange elements and reversible fluid flow heat transfer equipment. In one aspect, a shell and tube heat exchanger or the like is provided with a plurality of smooth-walled straight tubes of circular cross section and fluid handling means for pumping fluid, such as cooling water, reversibly through the interior of the tubes in indirect heat exchange with a process fluid on the shell side of the exchanger. Improved heat transfer efficiency is achieved with a turbulator device adapted for mounting inside each of the heat exchange tubes for reversible flow service.

SUMMARY OF THE INVENTION

It has been found that longitudinally slidable turbulator elements can be mounted inside heat exchange tubes to increase turbulence at predetermined points along the inner tube surface downstream of each turbulator. This results in cleaning of the tube interior by moving the zone of turbulence between fixed points in the tube. In a preferred embodiment of the invention, a tubular heat exchange comprises a plurality of longitudinally slidable turbulator devices for mounting in each of the tubes, each comprising a series of turbulator balls held within each of the tubes at longitudinally spaced points within the tubes, the balls permitting fluid flow around said balls adjacent the tube walls, each of said balls having a bore to permit a guideline to be stretched longitudinally therethrough; guideline retention means mounted at opposite ends of each tube for passing a guideline through each tube while permitting fluid to flow at opposite ends of said tubes substantially unrestricted; and a plurality of guideline-mounted ball stopping means disposed at fixed points between said guideline retention means and each of said balls to permit each of said balls to travel between stopping means during fluid flow reversal. The novel turbulator device may comprise a solid inert ball held on a rigid tension guideline, and the stopping means may comprise a crimped metal element larger than an adjacent ball bore.

DESCRIPTION OF PREFERRED EMBODIMENTS

Figure 1:
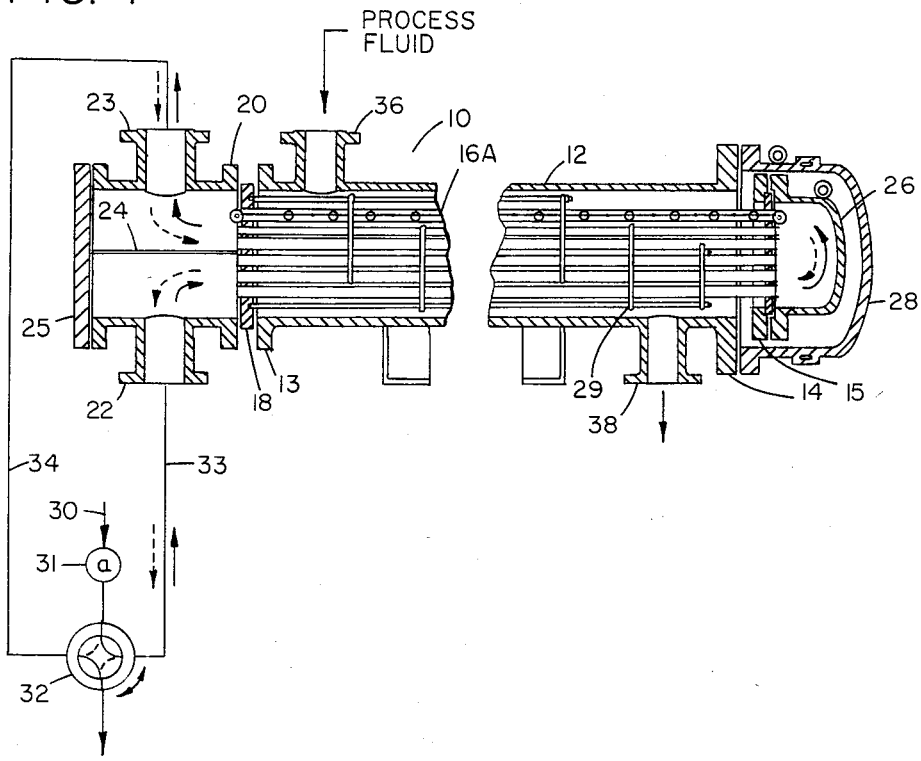
FIG. 1 is a vertical section view, partially cut away, of a typical shell and tube heat exchange apparatus, as may be used with the inventive turbulator.

Referring to FIG. 1, a heat exchange system 10 is adapted for use with turbulator devices of the present invention. The vertical section view along the longitudinal axis of a shell and tube exchanger is shown, including the main shell member 12 having shell flanges 13 and 14 at opposing ends thereof. Retained within the body of the shell are a plurality of straight heat exchange tubes 16 of which representative tube 16A is shown in longitudinal cross section to depict positioning of the turbulator devices therein. The tubes are maintained in their predetermined horizontal positions by a stationary tube sheet 18 and floating tube sheet 15. The stationary end of the heat exchanger is provided with a stationary head 20, having inlet and outlet ports 22, 23 and a pass partition 24 disposed between the stationary tube sheet and channel cover 25. At the opposite end, fluids are interconnected between tube passes by a floating head cover 26 over which is placed the end shell cover 28. Tubes and baffles are held in their desired locations by tie rod and spacer means 29. Fluid handling means is provided for pumping fluid reversibly through the interior of the tubes. This is accomplished by connecting a source of heat exchange fluid, such as coolant water 30 through pump 31 and four-way flow valve 32 via conduit 33 to port 22 and via conduit 34 to port 23. Ordinarily, a process fluid for the shell side of the exchanger is introduced at top shell nozzle 36 and withdrawn via bottom shell nozzle 38 at the opposite end.

Most of the standard heat exchanger components are constructed of metal such as steel, nickel, copper or the like; however, any suitable material of construction may be employed within the skill of the art. Usually tubular heat exchangers have smooth walled straight tubes of circular cross-section; however, other configurations are contemplated within the inventive concept, such as U-tube exchangers or the like. Advantageously, each of the heat exchanger tubes 16 is provided with a series of longitudinally spaced turbulator elements as shown in greater detail in FIG. 2.

During operation of heat exchange system 10, tube side fluid is maintained in a first flow direction indicated by the solid arrows from pump 31 via reversible valve 32 through the bottom first pass of tubes, reversing flow at the floating end, passing through the upper tube pass, and exiting on the opposite side of partition 24 through port 23 via conduit 34 and valve 32 to the outlet. The fluid handling function may be time actuated, automatically reversing fluid flow by operation of valve 32 at predetermined periods, or otherwise as determined by pressure drop readings and the like. During the flow reversal procedure, fluid flow on the tube side follows the dashed lines from pump 31, valve 32 via conduit 34 to port 23, etc.

Figure 2:
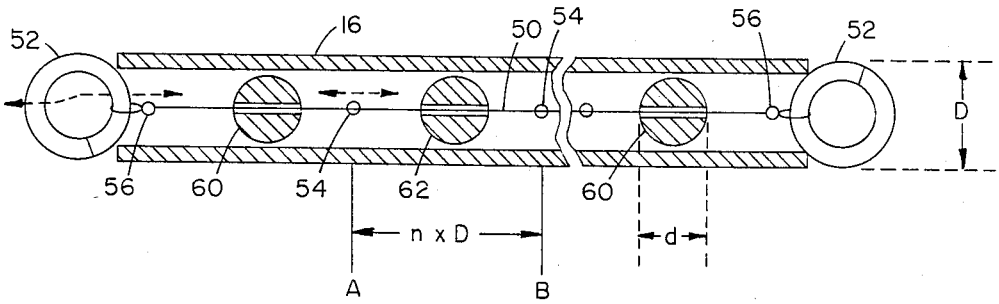
FIG. 2 is a detailed longitudinal section of a tubular heat exchanger element showing the mounting of a series of spaced turbulator balls movable between fixed points.

Referring now to FIG. 2, a heat exchange tube 16 is shown in longitudinal cross section having a guideline means 50 for retaining a plurality of longitudinally slidable turbulator devices for mounting in tube 16. In the preferred embodiment, these turbulator devices comprise a series of turbulator balls 60, each having a bore 62 larger than the guideline 50. At opposite ends of tube 16, guideline retention is provided by means of metal rings 52, to which are attached guideline 50 by tying, crimping, etc. These rings are larger than the inside diameter of tube 16 for free flow of fluid therethrough, while positioning the guideline coaxially with the tube 16 along the center line thereof. The turbulator balls 60 are held within the tube at longitudinally spaced points within the tube while permitting fluid flow around each of the balls adjacent the inner tube wall. Travel limits of the slidable turbulator elements is determined by a plurality of guideline mounted ball stopping means 54 disposed at predetermined fixed points between the guideline end retainers 52, thereby permitting each of the turbulator balls 60 to travel between stops 54 during fluid flow reversal.

Advantageously, the turbulator devices comprise spheroidal elements manufactured of an inert temperature-resistent polymeric material, such as polyolefin plastic or the like. The guideline should have a sufficient stiffness to perform its function in holding the turbulator devices during use. A typical material which may be used is a polymeric filament made of aramid plastic; however, metal wire or the like may be substituted within the skill of the art. Stopping means 54 and end crimpers 56 can be constructed of split shot lead crimped onto the guideline at predetermined positions prior to assembly of the turbulator device within the tubes. It is sufficient that the stopping means have a transverse dimension that is larger than the borehole 62 of the balls to prevent their sliding past the stop means.

The slidable turbulator elements may be characterized by relative diameter, cross-sectional area ratio to the conduit flow area and linear spacing along the longitudinal conduit axis. In the embodiment wherein spheroidal turbulator elements are retained within a circular tube, a diametric ratio d/D of about 0.5 to 0.95 may be advantageous, with a preferred diameter being particularly effective at a ratio from greater than 0.7 to about 0.85. In the case of heat transfer for a condenser-type heat exchanger with spherical turbulators (d/D=0.82), the heat transfer coefficient can be increased markedly by changing the spacing pitch from about 8 turbulator diameters to about 5 diameters.

In order to demonstrate the inventive concept a standard industrial shell and tube heat exchanger equipped with 5 cm. (2-inch) i.d straight metal tubes is operated under water-cooled condensation duty with hot ammonia shellside. The unmodified heat exchanger without turbulators has a clean tube heat exchange coefficient (U) of 14.5 BTU/hr-ft$^2$-°F. Equipped with turbulator devices as described herein, including inert plastic balls (d/D=0.82), the clean tube heat exchange coefficient is increased at logitudinal spacing between balls up to eight diameters (tube i.d.). For this configuration optimum spacing of $4\frac{1}{2}$–5 tube diameters (about 9 inches) results in an increase of coefficient to about 23 BTU/Hr-ft$^2$-°F., a 58% increase with total pressure drop along the tubes of about 35 kPa ($\Delta P \sim 5$ psi).

While the turbulator deposit prevention function can be retained without increasing heat transfer efficiency, it is advantageous to retain both functions. As the turbulator ball diametric ratio is increased to 0.85 and higher, overall heat transfer can be decreased below the clean tube value. Also, large diameter turbulators tend to cause excessive pressure drop.

Various modifications can be made within the skill of the art, and there is not intent to limit the inventive concept except as set forth in the following claims.

I claim:

1. A turbulator device adapted for insertion into an elongated tube for inducing turbulent fluid flow therein comprising a thin uniform guideline, retention means attached at opposite ends of the guideline for retaining the guideline in the tube;

a plurality of slidable spheroidal turbulence inducing elements having a center hole to permit insertion of the guideline therein, a series of spaced apart guideline stop means affixed to the guideline between each of the spheroidal elements, means for pumping fluid reversibly through the tube, whereby location of turbulent fluid flow zones within the tube may be changed by reversing direction of fluid flow within the tube.

2. The turbulator device of claim 1 wherein said spheroidal elements comprise an inert temperature-resistant polymeric material, said guideline comprises a stiff polymeric filament, and the retention means comprises at least one ring having an outer dimension larger than the tube whereby the guideline is held between opposite ends of the tube.

3. The turbulator device of claim 1 wherein said spheroidal elements have a cross-sectional diameter about 50 to 85% of the tube inside diameter.

4. The turbulator device of claim 3 wherein said spheroidal elements are spaced apart longitudinally up to eight tube diameters, and wherein said turbulator device provides turbulent fluid flow at a total pressure drop not exceeding about 35 kPa.

5. A shell and tube type heat exchanger having a plurality of tubes, each of said tubes having a turbulator device according to claim 1.

6. In a tubular heat exchanger comprising a plurality of smooth-walled straight tubes of circular cross section each of said tubes being mounted on opposite ends through a tube sheet within a heat exchange shell, the improvement which comprises:

fluid handling means for pumping fluid reversibly through the interior of said tubes;

a plurality of longitudinally slidable turbulator devices for mounting in each of said tubes, each comprising a series of turbulator balls held within each of said tubes at longitudinally spaced points within said tubes, said balls permitting fluid flow around said balls adjacent the tube walls, each of said balls having a bore to permit a guideline to be stretched longitudinally therethrough;

guideline retention means mounted at opposite ends of each tube for passing a guideline through each tube while permitting fluid to flow at opposite ends of said tubes substantially unrestricted;

a plurality of guideline-mounted ball stopping means disposed at fixed points between said guideline retention means and each of said balls to permit each of said balls to travel between stopping means during fluid flow reversal.

7. The heat exchanger of claim 6 wherein said balls have a diameter of at least 70% of tube diameter.

8. The heat exchanger of claim 6 wherein solid inert balls are held on a rigid tension guideline and said stopping means comprises a crimped metal element larger than an adjacent ball bore.

9. The heat exchanger of claim 6 wherein said turbulator balls have a tube diametric ratio of about 0.5:1 to 0.9:1; and are longitudinally spaced apart about $4\frac{1}{2}$ to 8 tube diameters, based on tube inside diameter.

10. A shell and tube heat exchanger according to claim 9 wherein said turbulator balls have a diametric ratio of about 0.7:1 to 0.85:1.

11. The heat exchanger of claim 6 wherein the heat exchange coefficient of metal tubes equipped with said turbulator devices is increased by at least 50% over said tubes without turbulator devices.

12. In a tubular heat exchanger comprising a plurality of smooth-walled straight tubes of circular cross section each of said tubes being mounted horizontally on opposite ends through a tube sheet within a heat exchange shell, the improvement which comprises:

fluid handling means for pumping fluid reversibly through said tubes;

a plurality of longitudinally slidable tubulator devices for mounting in each of said tubes, each comprising a series of tubulator balls held within each of said tubes longitudinally spaced within said tubes up to about eight tube diameters apart, said balls permitting fluid flow around said balls adjacent the tube walls, each of said balls having a longitudinal bore for slidably engaging the guideline;

guideline retention means mounted at opposite ends of each tube for passing a guideline through each tube while permitting fluid flow at opposite ends of said tubes substantially unrestricted;

a plurality of guideline-mounted ball stopping means disposed along said guideline between each of said balls to permit each of said balls to be released for travel between stopping means during fluid flow reversal.

* * * * *